United States Patent [19]

Votte

[11] 4,307,552

[45] Dec. 29, 1981

[54] SYNTHETIC ROOFING ELEMENTS OF THE SLATE TYPE AND A METHOD OF MANUFACTURING SAME

[76] Inventor: André T. Votte, Residence Parc d'Auteuil Rue Jean Jaurès, 59390 Lys-lez-Lannoy, France

[21] Appl. No.: 81,685

[22] Filed: Oct. 4, 1979

[30] Foreign Application Priority Data

Oct. 13, 1978 [FR] France ..... 78 29227

[51] Int. Cl.[3] ..... E04D 1/20

[52] U.S. Cl. ..... 52/309.13; 52/555; 52/631; 52/DIG. 9; 52/741; 428/147; 428/172; 428/286

[58] Field of Search ..... 52/309.1, 309.13, 71, 52/631, 311, 741, DIG. 9, 555; 428/99, 132, 141, 147, 160, 172, 176, 181, 215, 287, 286

[56] References Cited

U.S. PATENT DOCUMENTS

| | | | |
|---|---|---|---|
| 3,247,636 | 4/1966 | Mick et al. | 52/309.1 |
| 3,300,927 | 1/1967 | Bettoli | 52/309.13 |
| 3,332,192 | 7/1967 | Kessler et al. | 52/309.1 X |
| 3,386,001 | 5/1968 | Slosberg et al. | 52/309.1 X |
| 3,399,091 | 8/1968 | Cornay et al. | 52/309.1 |
| 3,461,628 | 8/1969 | Wienand et al. | 52/309.1 |
| 3,731,449 | 5/1973 | Kephart | 52/631 |
| 3,943,022 | 3/1976 | Susnjara | 52/631 X |
| 4,024,684 | 5/1977 | Holmgren | 52/741 X |
| 4,045,603 | 8/1977 | Smith | 428/147 X |
| 4,151,687 | 5/1979 | Kephart | 52/631 |

FOREIGN PATENT DOCUMENTS

| | | | |
|---|---|---|---|
| 2278646 | 2/1976 | France | 52/DIG. 9 |

*Primary Examiner*—J. Karl Bell

*Attorney, Agent, or Firm*—Fisher, Christen & Sabol

[57] ABSTRACT

For obtaining a roofing element of the slate type, a synthetic material such as polyethylene, polypropylene or polyvinylchloride is mixed with a charge, such as chalk, kaolin, dolomite, talc, and with carbon black. The proportion by weight of synthetic material is between 30 and 60%, whereas that of the charge is between 20 and 60% and that of the carbon black is between 0.5 and 5%. The mixture is extruded and then calendered.

6 Claims, 7 Drawing Figures

SYNTHETIC ROOFING ELEMENTS OF THE SLATE TYPE AND A METHOD OF MANUFACTURING SAME

The present invention relates to synthetic roofing elements and a method of manufacturing same.

It has already been contemplated, as is known, to replace certain conventional roofing elements, such as tiles, slates, etc. . . , by elements from materials other than the natural material from which they have always been made. Thus, less expensive constructional elements are obtained which lower correspondingly the constructional costs of which they form part. However, it has been realized in practice that, on one hand these new elements did not offer a great resistance to erosion by the elements, and on the other hand that their esthetical appearance was not satisfactory.

The invention has as its aim to remedy these disadvantages. It relates to roofing elements, made from synthetic material, resisting erosion perfectly well and capable, if necessary, of resembling the conventional constructional elements currently used, to the extent of mistaking them.

To this end, in accordance with the invention, a construction element is remarkable in that it is made from a synthetic material such as polyethylene, polypropylene or polyvinylchloride to which at least one charge and carbon black is added.

Thus is obtained a cheap covering element which does not deteriorate, in which the carbon black serves both as agent for conferring thereon a good resistance to ultraviolet rays and as colouring matter.

The charge may be mineral, vegetable or organic. However, it is advantageous to use a mineral charge such as chalk, kaolin, dolomite, talc or a similar material. Furthermore, the element comprises at least one fireproofing agent. To obtain the element according to the invention, the synthetic material of divided particules may be added to different charges and additives, after which said mixture is fed into an extruder, said extruder having a die corresponding to the section of the element to be obtained.

The element according to the invention may be made from a virgin synthetic material. However, it is particularly advantageous if the synthetic material comes from the recovery of objects or waste.

The product leaving the extruder may be subjected to a calendering operation.

The figures of the accompanying drawings will help in understanding how the invention may be achieved.

Figure 1:
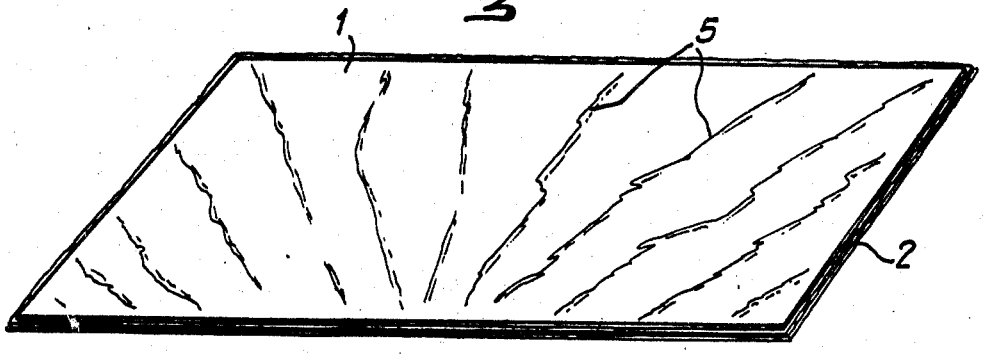
FIG. 1 is a perspective view of a synthetic slate according to the invention.

The roofing element 1 of the invention, shown in perspective in FIG. 1, is intended to replace natural slates, not only insofar as their use is concerned but also their esthetic appearance.

For this, this element 1 is in the usual flattened rectangular form, with edges 2 whose thickness decreases by steps.

To construct such a slate, recovered polyethylene, polypropylene, polyvinylchloride waste may be used. It may be films, for example, for packing, bags, etc. . . These films are then fed into a densifier (tank provided with a mixing screw) and are densified therein with introduction of water, until a polyethylene, polypropylene or polyvinylchloride "semolina" is obtained. Said waste may also be compact (manufacturing rejects or plugs for example); in this case, they are simply crushed until a powder or particles are obtained.

The material thus prepared is then fed into a tower having vertical mixing screw, with the desired additives. It will be noticed, that, depending on the qualities of flexibility or rigidity required for the final product, a synthetic material may be fed into the tower coming either from low density waste, or from high density waste, or else from a mixture of the two or medium density waste.

Among the additives, a mineral, vegetable or organic charge is chosen, for example a mineral charge such as chalk, dolomite, talc etc. . . These additives may also comprise at least one fireproofing agent and at least one agent for dispersing the additives in the synthetic material.

To construct a synthetic slate of the type shown in the figure, the following composition by weight may be used:

low density polyethylene: from 30 to 50%
high density polyethylene: from 5 to 20%
powdery charge (chalk, kaolin, etc. . . ): from 20 to 60%
chlorinated paraffine (fireproofing agent): from 2 to 15%
antimony oxide (fireproofing agent): from 0 to 10%
zinc borate (fireproofing agent): from 0 to 5%
carbon black (agent for protection against ultraviolet rays): from 0.5 to 5%.

It will be noticed that the carbon black, in addition to its protection role against ultraviolet rays, is a powerful colouring agent. The colouring power of carbon black is often a serious disadvantage in the use thereof as an agent for protecting against ultraviolet rays, since objects which contain it are then necessarily of a dark colour. In the present case of application, carbon black gives at the same time to the roofing elements of the invention a colour practically identical to that of natural slates.

The homogeneous mixture leaving the mixing tower is fed into an extruding-plasticizing machine, at the outlet of which is provided a calendering device.

Figure 2:
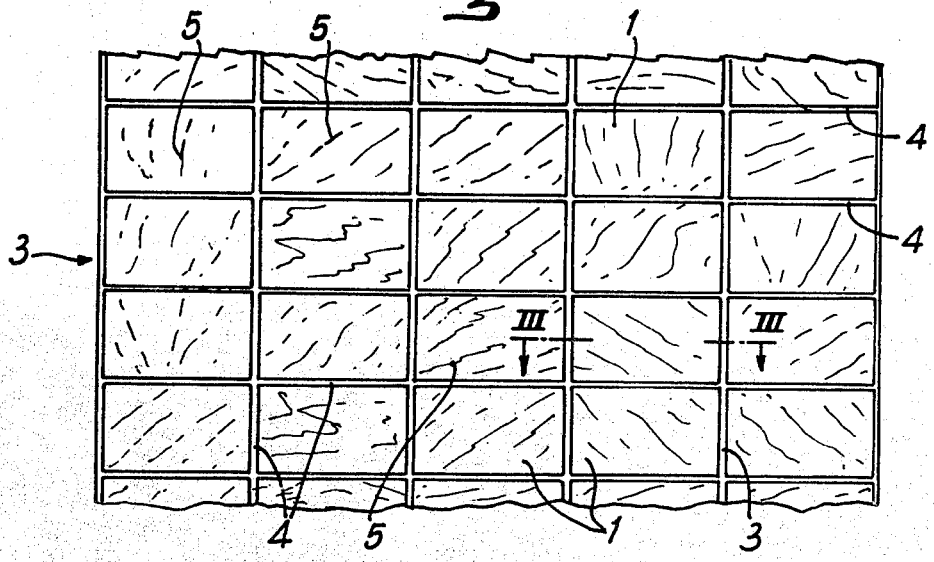
FIG. 2 illustrates a part of a process for manufacturing the slate of FIG. 1.
Figure 3:
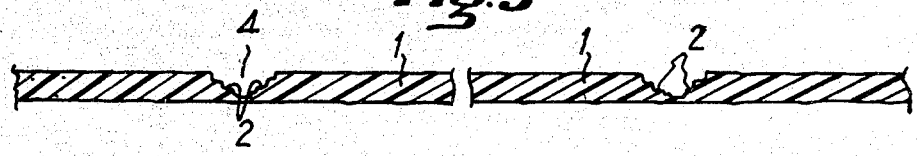
FIG. 3 is a section along line III—III of FIG. 2.

The extruding-plasticizing machine supplies at its outlet a flat endless band 3 and in this band, the calendering device defines a plurality of slates 1, separated by separation lines 4 forming the stepped edges 2 of adjacent slates and imprints on each slate 1 surface patterns 5 imitating the appearance of the real slate (FIGS. 2 and 3). The separation lines 4 may be cut either at the time of calendering, or thereafter, to obtain individual slates.

Thus are obtained slates having the same appearance as real slates, light (300 g for dimensions of 32 cm×22 cm), fireproof and totally resistant to deterioration. Of course, such slates could also be obtained by injection or compression molding.

Figure 4:
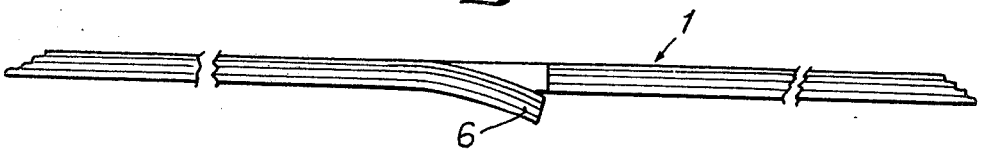
FIG. 4 illustrates in a side view another embodiment of the slate according to the invention.
Figure 5:
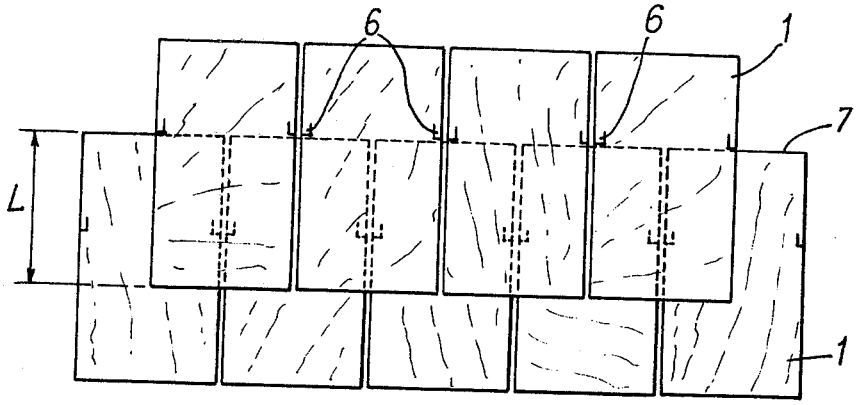
FIG. 5 illustrates schematically the laying of slates in accordance with FIG. 4.

In FIG. 4, there is shown another embodiment of the roofing element 1 of the invention. In this case the elements comprise projections 6, obtained for example by pressing, along their longitudinal edges, for accurate positioning thereof when laying, by supporting said projection 6 on the upper transverse edge 7 of the underlying elements (see FIG. 5). The laying of individual slates 1 may be carried out in a known way by nailing or by means of hooks. It is also possible to obtain directly, for example by calendering, panels imitating rows of slates already laid and to construct a roof by laying such panels and not by laying individual synthetic slates.

Figure 6:
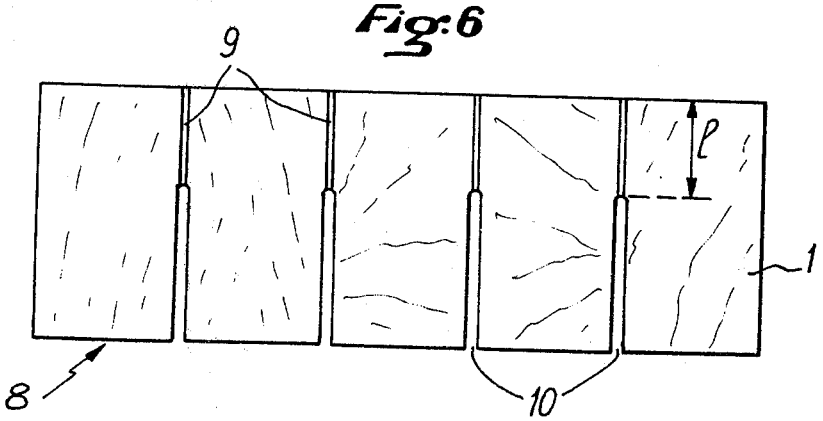
FIGS. 6 and 7 illustrate respectively in the flat and folded condition an assembly of slates according to the invention, intended to facilitate the laying thereof.
Figure 7:
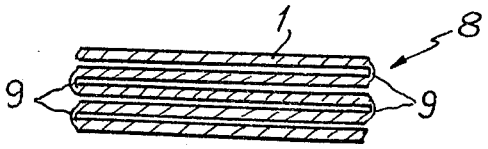

To facilitate the laying of individual synthetic slates, there may be provided as shown in FIGS. 6 and 7 assemblies 8 of slates 1 connected at long at least a part of their natural edges by thinner hinging lines 9. Thus, these assemblies 8 may be folded up in zigzag fashion (FIG. 7) to form compact assemblies easy to store and transport. At the time of laying, the assemblies 8 are unfolded, and laid out flat to allow the simultaneous positioning of the slates of an assembly. Preferably, for esthetic reasons, the hinging lines 9 only extend over a length 1 equal to or less than the overlapping length L of two successive rows of slates, so as to be hidden by the slates of the upper row. Over the rest of the length of the slates, two consecutive slates 1 of an assembly 8 are separated by a slit 10, corresponding to normal spacing.

I claim:

1. A semi-rigid roofing element resembling slate, said element including integrally formed means for positioning the element in correct overlapping relationship to an underlying roofing element already in place, said element being composed of a synthetic material such as polyethylene, polypropylene or polyvinylchloride, with which is combined a charge of filler material such as chalk, kaolin, dolomite, talc or a similar material and carbon black, the proportion by weight of synthetic material being between 30 and 60%; that of the charge of filler material being between 30 and 60% and that of the carbon black being between 0.5 and 5.0%.

2. A roofing element as defined in claim 1, wherein the composition includes at least one fireproofing agent.

3. A roofing element as defined in claim 1, wherein said means for positioning the element comprises a pair of horizontally spaced downwardly projecting integrally formed finger-like members.

4. A roofing element as defined in claim 1, wherein said element is subdivided into a plurality of semi-rigid elements resembling natural slate articles disposed in side-by-side relationship and joined to each other over at least a portion of their adjacent margins by vertically elongated narrow areas of reduced thickness defining hinges, permitting adjacent elements to be folded together for storage.

5. A process for producing a semi-rigid roofing element as defined in either claim 1 or claim 3 comprising the steps of:

reducing the synthetic material to the form of divided particles;

mixing the divided particles with the filler material and additive composition, and;

introducing said mixture into an extruder.

6. A process as defined in claim 5, wherein said synthetic material comprises recycled waste products.

* * * * *